US008857813B1

(12) United States Patent
Piatt et al.

(10) Patent No.: US 8,857,813 B1
(45) Date of Patent: Oct. 14, 2014

(54) CUT SHEET MEDIA INVERTING SYSTEM

(71) Applicants: Michael Joseph Piatt, Dayton, OH (US); Harsha S. Bulathsinghalage, Miamisburg, OH (US)

(72) Inventors: Michael Joseph Piatt, Dayton, OH (US); Harsha S. Bulathsinghalage, Miamisburg, OH (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 13/951,506

(22) Filed: Jul. 26, 2013

(51) Int. Cl.
*B65H 29/00* (2006.01)

(52) U.S. Cl.
USPC ..... 271/185; 271/277; 271/276

(58) Field of Classification Search
CPC ..... B65H 15/00; B65H 2301/332; B65H 2301/33214; B65H 2301/333; B65H 2301/34112; B65H 5/224; B65H 5/226; B65H 5/12
USPC ..... 271/275–277, 185, 186
See application file for complete search history.

(56) References Cited

U.S. PATENT DOCUMENTS

| | | | |
|---|---|---|---|
| 4,496,142 | A | 1/1985 | Iwasaki |
| 5,374,049 | A | 12/1994 | Bares et al. |
| 5,772,343 | A | 6/1998 | Beretta et al. |
| 6,463,256 | B2 | 10/2002 | Blackman |
| 6,851,672 | B1 | 2/2005 | Shmaiser et al. |
| 6,912,952 | B1 | 7/2005 | Landa et al. |
| 7,400,855 | B2 | 7/2008 | Bokelman et al. |

*Primary Examiner* — Michael McCullough
(74) *Attorney, Agent, or Firm* — Kevin E. Spaulding

(57) ABSTRACT

A media inverting system for inverting a media sheet, including a first media transport, a rotatable member, and a second media transport. A rotatable member force mechanism is switchable between a first state where a first side of the media sheet is held to the rotatable member and a second state where the media sheet is released. A control system controls the rotatable member force mechanism according to a control sequence including: switching the rotatable member force mechanism to its first state to receive the media sheet from the first media transport and hold the media sheet to the rotatable member while it is wrapped around the rotatable member; and switching the rotatable member force mechanism to its second state to release the media sheet in synchronization with the media sheet being received by the second media transport.

21 Claims, 18 Drawing Sheets

CUT SHEET MEDIA INVERTING SYSTEM

FIELD OF THE INVENTION

This invention pertains to the field of media handling for cut-sheet printing systems, and more particularly to an apparatus inverting the media sheets for printing on a second side.

BACKGROUND OF THE INVENTION

In a digitally controlled printing system, a receiver media (also called a print media) is directed through a series of components for printing an image. The receiver media can be a continuous web of media or a sequential flow of cut sheets of media. In the case of a cut-sheet printing system, a media transport system physically moves the receiver media sheets through the printing system. As the receiver media sheets move through the printing system, a printing process is carried out on a first side of the receiver media sheets. For example, in an inkjet printing system, liquid (e.g., ink) is applied to the receiver media sheet by one or more printheads through a process commonly referred to as jetting of the liquid.

In many printing applications it is desirable to print on both sides of the receiver media sheets, thereby saving cost and being more environmentally friendly. Some printing systems are capable only of printing on a single side of the receiver media sheets. In this case, a user who wishes to print on both sides of the receiver media sheets can print the odd numbered pages, reload the stack of print media sheets, and then print the even numbered pages. However, this is slow and cumbersome. A more user-friendly printing system is one that includes a media inverter, also called a duplexer, for duplex printing.

Desktop printing systems typically use a carriage to move a printhead across the receiver media sheet to print a swath of an image and advance the receiver media sheet between swaths in order to form the image swath-by-swath. Such printing systems are small and low-cost, but printing throughput on single sides of letter-sized receiver media sheets is typically limited to around 20-30 pages per minute. Because the distance the receiver media sheet is moved through a desktop printing system is small, the transport system can be a series of rollers. Printing of all of the colors of the image is performed in a relatively small print zone compared to the length of the receiver media sheet. For printing a single side, the receiver media sheet is advanced swath-by-swath sequentially past the print zone. For duplex printing, the receiver media sheet is typically driven through a duplexer by one or more rollers to turn the receiver media sheet over and return the receiver media sheet to a point prior to the print zone so that the second side can be printed.

High-volume cut-sheet printing systems typically print one color of an entire line of the image essentially all at once, for example using a page-width printhead or some other page-width printing process in a printing station for that color. The receiver media sheet is advanced past the printing station as sequential page-width lines of the same color are printed. To print all colors (typically cyan, magenta, yellow and black), the receiver media sheet is moved from printing station to printing station, each printing station printing a different color. In a high volume inkjet printing system, there are typically dryers between some or all of the printing stations in order to remove some of the carrier fluid of the ink and make the ink less mobile so that it is less susceptible to bleeding into the next color that is printed.

In web printing systems, tension in the continuous web of receiver media can be used to pull the web through the various printing stations. In high-volume cut-sheet printing systems, a media transport system, which typically includes components such as belts or drums, is used to move the receiver media sheets through the printing system from one printing station to the next. High-volume cut-sheet printing systems tend to be significantly larger and more costly than desktop printing systems. However, the printing throughput is also typically significantly higher.

Because of the successive printing stations, and other stations such as dryers or fusers, in a high-volume cut-sheet printing system, the distance between the input to the first printing station and the output of the last printing station can be relatively large compared to the length of the receiver media sheet. A simple roller-driven duplexer that can position the lead edge of the receiver media sheet close enough to the print zone that a feed roller can begin to pull the leading edge before trailing edge of the receiver media sheet passes the duplexer drive roller is not adequate in such a large high-volume cut-sheet printing system. Furthermore, some high-volume cut-sheet printing systems include a first printing module including all of the color printing stations for printing a first side of the media sheets, and a second printing module including all of the color printing stations for printing a second side of the media sheets. A media inverter is positioned between first printing module and the second printing module.

Many cut sheet media inverters that are disclosed in the prior art include one or more rollers or other rotatable member (s) that reverse direction as part of the media inversion process. U.S. Pat. No. 5,374,049 to Bares et al., entitled "Compact inverter," discloses a reversible roller onto which a sheet is scrolled and subsequently unscrolled, thereby reversing the lead and trail edges of the sheet.

U.S. Pat. No. 6,851,672 to Shmaiser, entitled "Sheet transport position and jam monitor," includes a "perfector transporter" that changes direction of rotation from counterclockwise to clockwise during inversion of the sheet.

U.S. Pat. No. 4,496,142 to Iwasaki et al., entitled "Sheet supplying device for two-sided copying," discloses holding one-side-copied sheets by a plastic film wound on a scroll in a first direction, and then reversing the scroll to invert the one-side-copied sheets.

U.S. Pat. No. 7,400,855 to Bokelman et al., entitled "Winding media," discloses winding sheets of paper around two winding members that wind the paper beginning in the middle of the paper rather than at an end. The winding device reverses direction to enable unwinding the paper for inversion.

U.S. Pat. No. 6,463,256 to Blackman, entitled "Duplexing module for printer," discloses a feed roller that reverses direction during the media inversion process.

U.S. Pat. No. 5,772,343 to Beretta et al., entitled "Media handling system for duplex printing," discloses winding the paper on a metering roller. The direction of the metering roller is reversed during sheet inversion.

U.S. Pat. No. 5,772,343 to Beretta et al., entitled "Media handling system for duplex printing," discloses a first and second roller. During first side printing, a media sheet is fed along the first roller and directed to a second roller. After a drying time, the second roller reverses direction moving the media sheet back toward a reefed guide.

U.S. Pat. No. 6,241,236 to Bokelman, entitled "Automated sheet delivery to selected paths using reversible crenellated roller," discloses a transport roller assembly having a direction of rotation that is reversed to re-route the sheet back for further processing.

Since high-volume cut-sheet printers have capability for high printing throughput, other components of such a printing system should be able to keep up with the printing throughput so that they do not compromise the overall throughput of the system. A media inverter that reverses direction of a roller or other rotatable member will have a limitation in throughput that is related to the slowing down, stopping and reversal of the roller direction. In addition, it is desirable that high-volume cut-sheet printing systems not be excessively large. There is an ongoing need for a media inverter that is compact and high speed for turning the cut receiver media sheets over for printing the second side of the media sheet.

SUMMARY OF THE INVENTION

The present invention represents a media inverting system for a cut sheet printing system, comprising:

a first media transport for advancing a media sheet along a first media transport path;

a rotatable member continuously rotating in a rotation direction, the rotatable member being adapted to receive the media sheet from the first media transport and wrap the media sheet around the rotatable member;

a rotatable member force mechanism switchable between a first state and a second state, such that when the rotatable member force mechanism is in its first state a first side of the media sheet is held to the rotatable member at least along a leading first edge of the media sheet, a trailing second edge of the media sheet not being held to the rotatable member, and when the rotatable member force mechanism is in its second state the media sheet is released from being held to the rotatable member;

a second media transport for receiving the media sheet from the rotatable member and advancing the media sheet along a second media transport path;

a second media transport force mechanism for holding a second side of the media sheet to the second media transport at least along the second edge of the media sheet;

a control system for controlling the rotatable member force mechanism according to a control sequence including:

switching the rotatable member force mechanism to its first state to receive the media sheet from the first media transport and hold the first side of the media sheet to the rotatable member while it is wrapped around the rotatable member; and switching the rotatable member force mechanism to its second state to release the media sheet from being held to the rotatable member in synchronization with the second edge of the media sheet being received by the second media transport such that the media sheet is unwrapped from around the rotatable member and advanced along the second media transport path so that the second edge of the media sheet becomes the leading edge.

This invention has the advantage that the media sheet is inverted in a compact space.

It has the additional advantage that the media transports and the rotatable member can be continuously operated without the need to reverse directions, thereby providing a high throughput required for high-speed printing systems.

BRIEF DESCRIPTION OF THE DRAWINGS

It is to be understood that the attached drawings are for purposes of illustrating the concepts of the invention and may not be to scale. Identical reference numerals have been used, where possible, to designate identical features that are common to the figures.

DETAILED DESCRIPTION OF THE INVENTION

Figure 1:
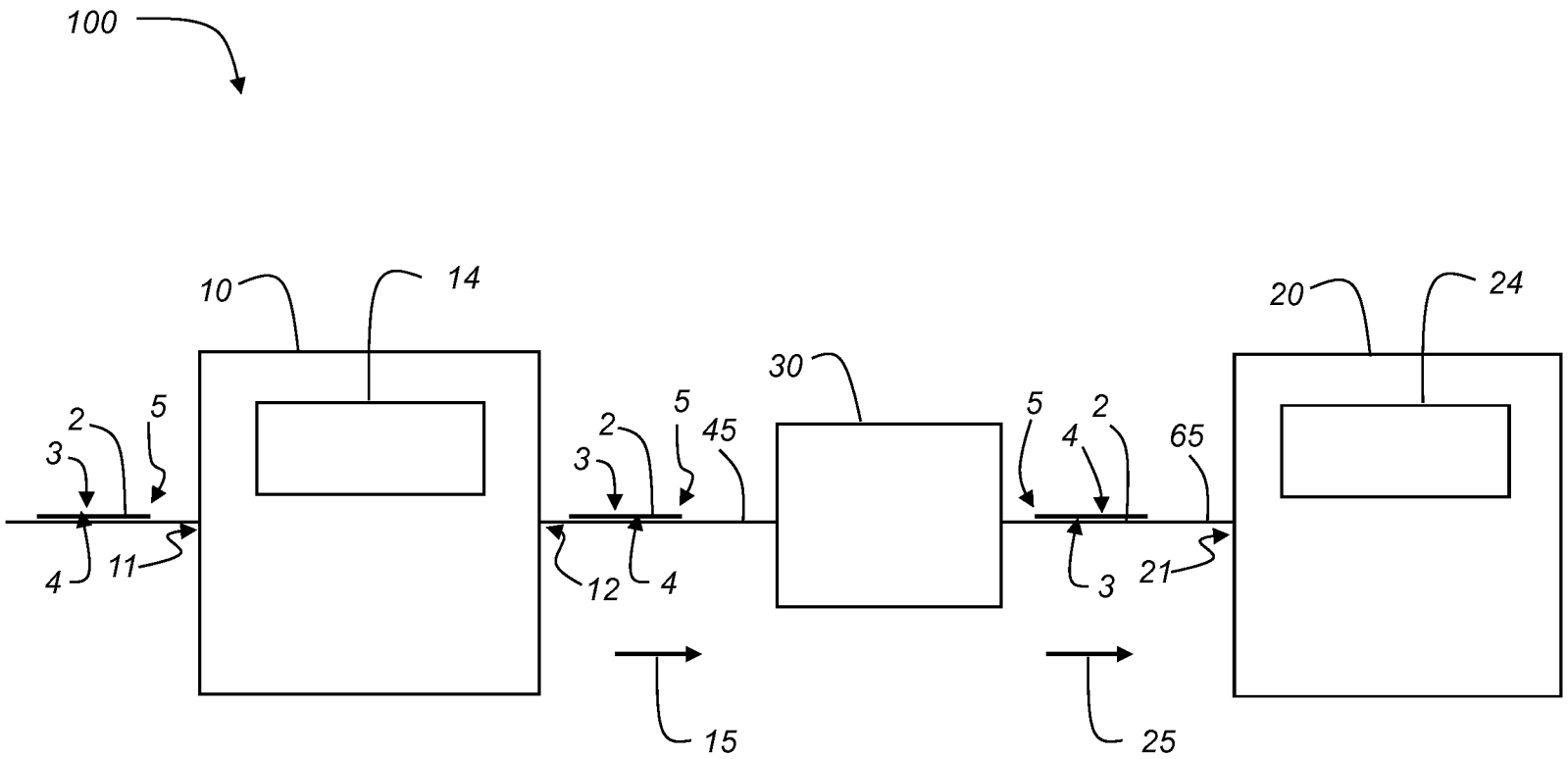
FIG. 1 shows a side view of a cut-sheet printing system including a first printing module, a media inverter and a second printing module.

The present description will be directed in particular to elements forming part of, or cooperating more directly with, an apparatus in accordance with the present invention. It is to be understood that elements not specifically shown, labeled, or described can take various forms well known to those skilled in the art. In the following description and drawings, identical reference numerals have been used, where possible, to designate identical elements. It is to be understood that elements and components can be referred to in singular or plural form, as appropriate, without limiting the scope of the invention.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. It should be noted that, unless otherwise explicitly noted or required by context, the word "or" is used in this disclosure in a non-exclusive sense.

The example embodiments of the present invention are illustrated schematically and not to scale for the sake of clarity. One of ordinary skill in the art will be able to readily determine the specific size and interconnections of the elements of the example embodiments of the present invention.

Cut sheets, also referred to as media sheets, refer to individual sheets of receiver media that are moved along a transport path through a printing system (or through some other type of media handling system). Cut-sheet printing systems are commonly used for printing on sheets of paper; however, there are numerous other materials for which cut-sheet printing is appropriate. For example, the media inverter described herein is compatible with media sheets made using flexible materials such as vinyl sheets, plastic sheets, or textiles.

The terms "upstream" and "downstream" are terms of art referring to relative positions along the transport path of the receiver media; points on the receiver media move along the transport path from upstream to downstream.

Referring to FIG. 1, there is shown a simplified side view of a portion of a cut-sheet printing system 100 including a first printing module 10, a second printing module 20, and a media inverter 30 positioned downstream of first printing module 10 and upstream of second printing module 20. A media sheet 2 (sometimes referred to as a "cut sheet") is shown at input 11 and output 12 of first printing module 10, and also at input 21 of second printing module 20 after passing through media inverter 30. In this example, at output 12 of first printing module 10, a media sheet 2 is shown moving along a media transport path 45 in a first direction 15 with a first side 4 held against the media transport path 45 and an opposite second side 3 facing away from media transport path 45, and with a first edge 5 being the most downstream edge of media sheet 2. This is the same orientation as media sheet 2 had at input 11 of first printing module 10. As media sheet 2 is moved through the first printing module 10, the media sheet is oriented so that the second side 3 is printed on by printing stations 14. After media sheet 2 exits the media inverter 30, it moves along media transport path 65 in second direction 25, with the orientation of the media sheet 2 being inverted so that the second side 3 is held against media transport path 65 and the first side 4 is facing away from media transport path 65. In the type of media inversion illustrated in FIG. 1, first edge 5 (i.e., the former leading edge) is now the most upstream edge of media sheet 2 (i.e., the trailing edge). Thus as media sheet 2 enters second printing module 20 at input 21 and passes through second printing module 20, first side 4 is properly oriented for printing on by printing stations 24. Printing data can be adjusted in second printing module 20 to print with first edge 5 now being the trailing edge.

Figure 2A:
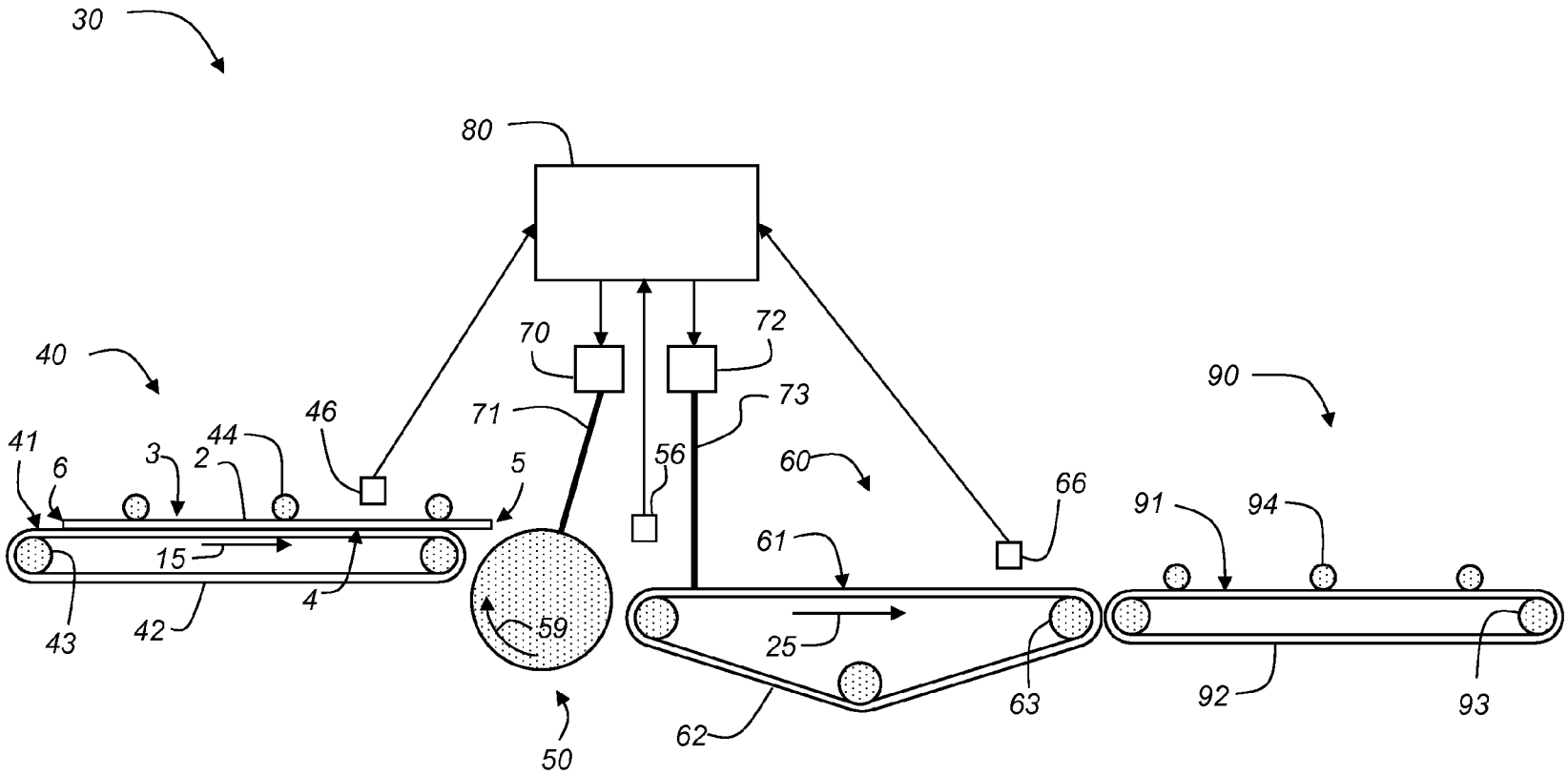
FIGS. 2A-2H show side views of a media inverter having a rotatable member at different points in the inversion process according to an embodiment of the invention where the rotatable member is a drum.

FIGS. 2A-2H show side views of a media inverter 30 of the type described above relative to FIG. 1 according to an exemplary embodiment. In FIG. 2A, media sheet 2 is being advanced along a first media path by first media transport 40 in first direction 15. In this embodiment, first media transport 40 is a transport belt system including a belt 42 that travels around a plurality of rollers 43. Upper belt portion 41 of belt 42 travels in first direction 15. In this example, it is the upper belt portion 41 of the belt 42 that defines the first media transport path. First side 4 of media sheet 2 is in contact with the upper belt portion 41 of belt 42, with second side 3 facing away from the belt 42. In the example shown in FIG. 2A, nip rollers 44 press against the second side 3 of media sheet 2 to hold the media sheet 2 against the upper belt portion 41 of belt 42 and advance the media sheet 2 along the first media transport path. First edge 5 of media sheet 2 is the most downstream edge (i.e., the lead edge) and second edge 6 of media sheet 2 is the most upstream edge (i.e., the trailing edge). A media sensor 46 can detect both first edge 5 and second edge 6 (e.g., optically or mechanically), and can provide a signal to controller 80 when the first edge 5 and the second edge 6 are detected. By measuring a time difference between detection of the first edge 5 and the second edge 6 and knowing the speed of belt 42, controller 80 can calculate the length of media sheet 2.

Figure 2B:
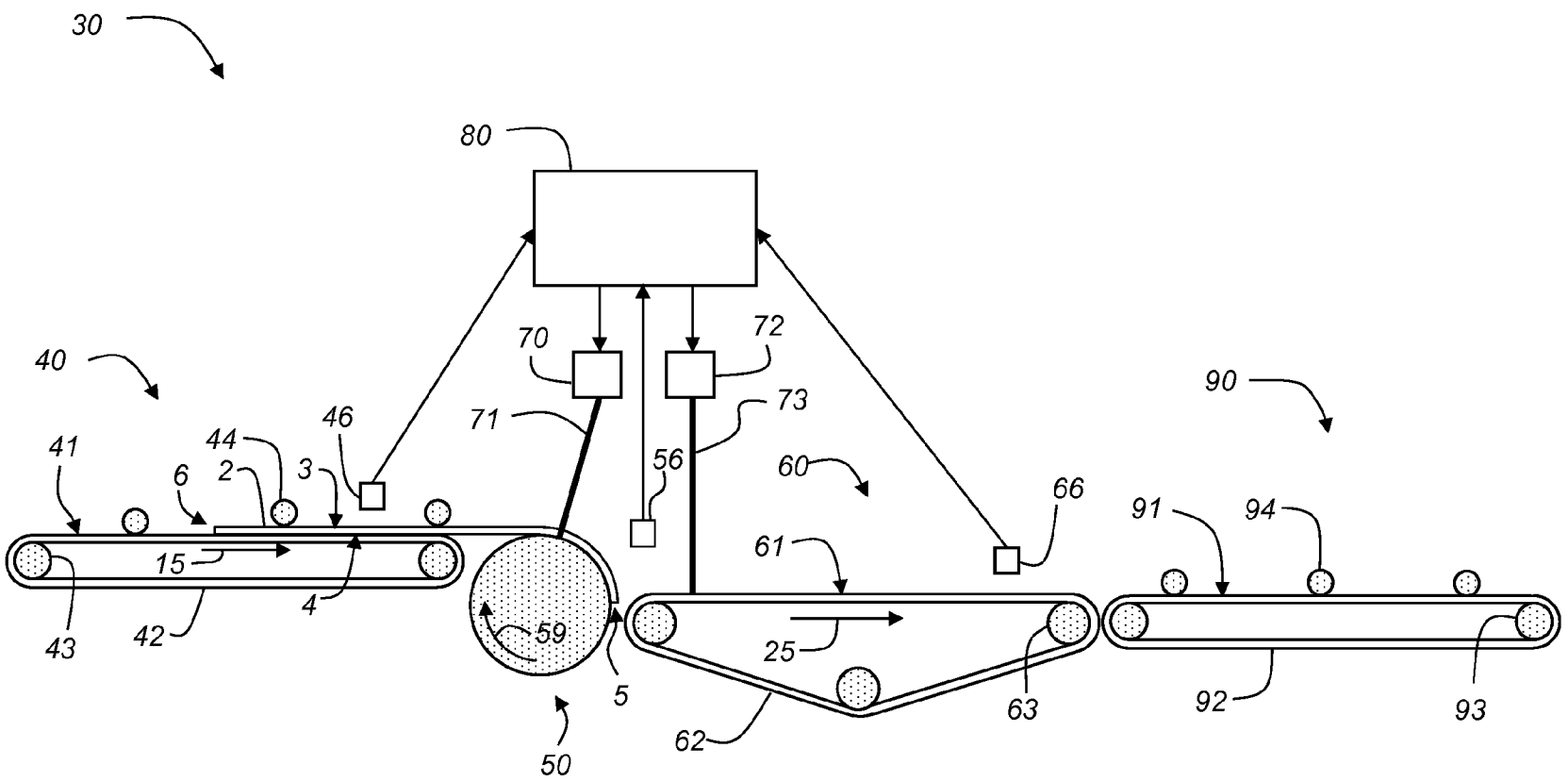

In addition to first media transport 40, the illustrated embodiment also includes a rotatable member 50 that is adapted to receive media sheet 2 from the first media transport 40. FIG. 2A shows first edge 5 of media sheet 2 extending from first media transport 40 toward rotatable member 50, which in this example is a drum that rotates in a rotation direction 59. FIG. 2B is similar to FIG. 2A, but shows a later time when a portion of media sheet 2 including the leading first edge 5 is wrapped around and held to rotatable member 50. In some embodiments, the rotation speed of the rotatable member 50 can be adjusted slightly while the media sheet 2 is being wrapped around it in order to control how tightly the media sheet 2 is held against the rotatable member 50.

In a preferred embodiment, the first side 4 of the media sheet 2 is held to rotatable member 50 by a vacuum force applied through vacuum holes 57 (see FIG. 3) at least along leading first edge 5 of media sheet 2. Vacuum drum systems for applying a vacuum force to a media sheet 2 to hold the media sheet 2 to the drum are well-known in the art, and any such system can be used to provide the vacuum force in accordance with the present invention. In more general terms, rotatable member 50 is provided a hold-down force by rotatable member force mechanism 70, where the hold-down force is applied through force transfer element 71. For example, rotatable member force mechanism 70 can include a vacuum pump or a blower that can be switched on and off, and force transfer element 71 can include tubing and a plenum for applying the vacuum to the vacuum holes 57 or in some embodiments vacuum grooves (not shown) in circumferential surface 54 (FIG. 3) of the drum. In a preferred embodiment, the rotatable member force mechanism 70 is switchable between a first state and a second state. In the first state, the first side 4 of media sheet 2 is attracted to and then held by rotatable member 50. In the second state, the media sheet 2 is released from being held to the rotatable member 50 as described below.

Figure 2C:
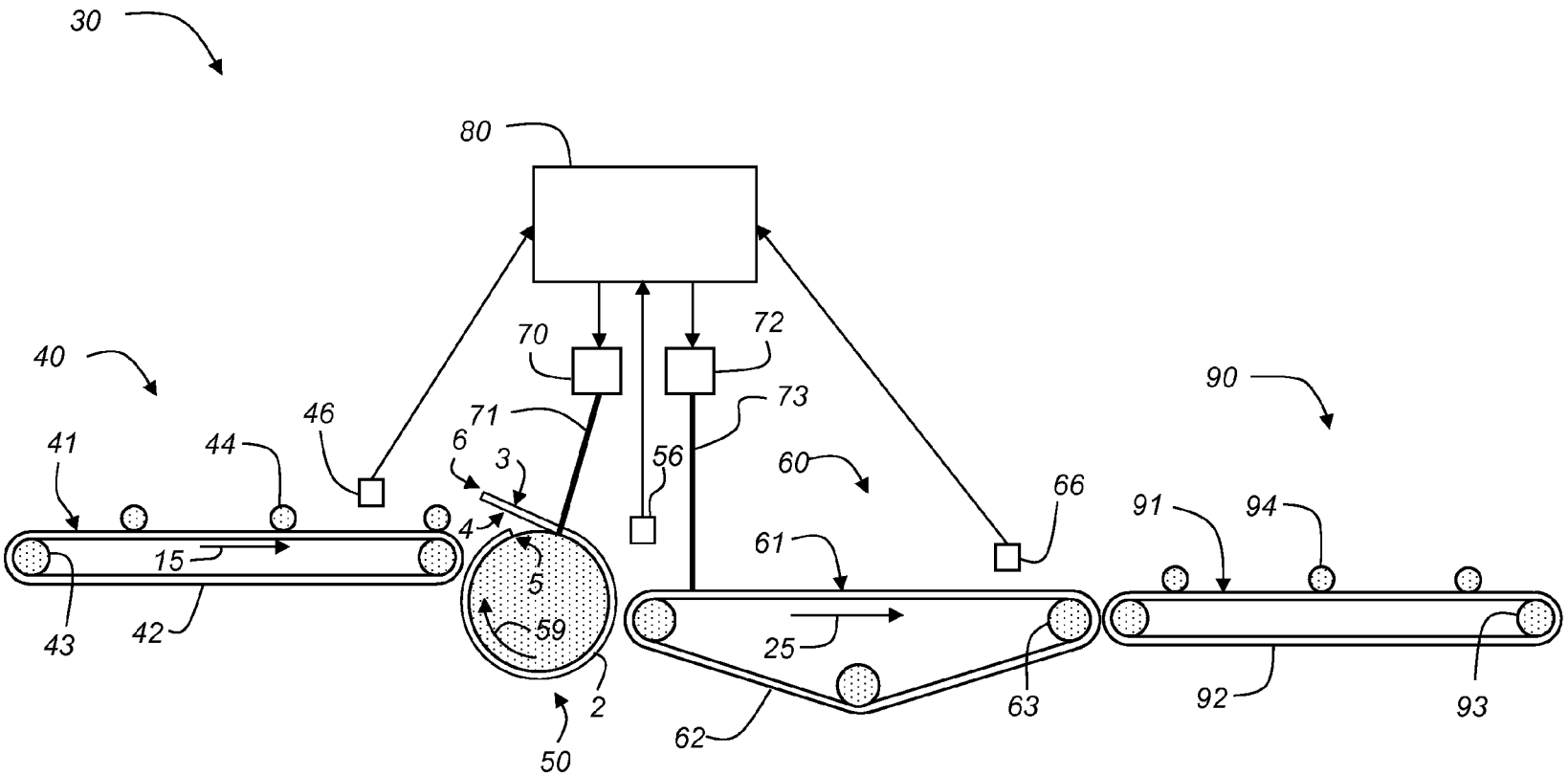

FIG. 2C is similar to FIG. 2B but shows a later time when nearly all of media sheet 2 is wrapped around and held to the circumferential surface 54 (FIG. 3) of the drum (i.e., rotatable member 50). In this example, the circumference of rotatable member 50 is less than a length between first edge 5 and second edge 6 of the media sheet 2, such that the second edge 6 of the media sheet 2 overlaps the first edge 5. For a hold-down force such as vacuum, it is only the portion of media sheet 2 that contacts vacuum holes 57 (FIG. 3) that is held to the surface of rotatable member 50. Thus the overlapping portion of media sheet 2 proximate to the second edge 6 is not held to the surface of rotatable member 50. Generally, the stiffness of the media sheet 2 will cause the unsecured portion of the media sheet 2 proximate to the second edge 6 to extend out from the surface of the rotatable member 50.

Figure 2D:
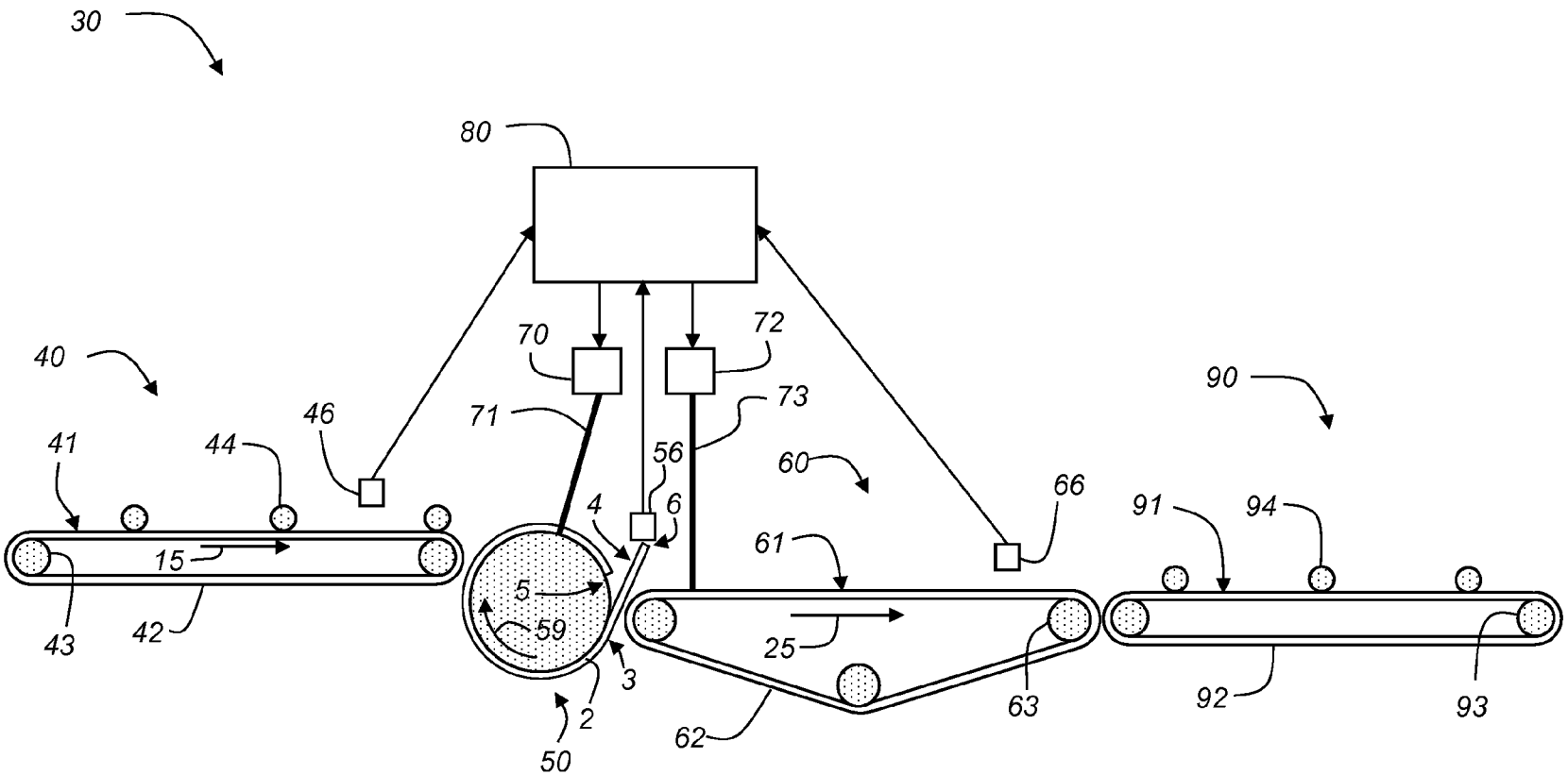

FIG. 2D is similar to FIG. 2C but shows a later time when second edge 6 of media sheet 2 is approaching a second media transport 60 for receiving the media sheet 2 from the rotatable member 50 and advancing the media sheet 2 along a second media transport path. A media sensor 56 near the entrance of second media transport 60 can detect when second edge 6 passes by (e.g., optically or mechanically) and sends a signal to the controller 80. In some embodiments, media sensor 56 can be a vacuum pressure sensor that detects when media sheet 2 is fully wrapped around rotatable member 50 and covers the vacuum holes, thereby reducing the amount of escaped air from the rotatable member 50. In the illustrated embodiment, second media transport 60 is a transport belt system including a belt 62 that travels around a plurality of rollers 63. Upper belt portion 61 of belt 62 travels in second direction 25. In this example, it is the upper belt portion 61 of the belt 62 that defines the second media transport path.

Second media transport 60 has a second media transport force mechanism 72 with force transfer element 73. In a preferred embodiment, the second media transport force mechanism 72 is switchable between a first state and a second state. In the first state, the second side 3 of media sheet 2 is attracted to and held to second media transport 60. In the second state, the media sheet 2 is released from being held to the second media transport 60. In a preferred embodiment, second media transport 60 is a vacuum belt system and second media transport force mechanism 72 includes a vacuum pump or a blower. In some embodiments, the second media transport force mechanism 72 provides a holding force that holds the entire media sheet 2 to the second media transport 60. In other embodiments, the second media transport force mechanism 72 provides a holding force that holds only a portion to the media sheet 2. Preferably, the held portion of the media sheet 2 includes a region proximate to the second edge 6.

Figure 4:
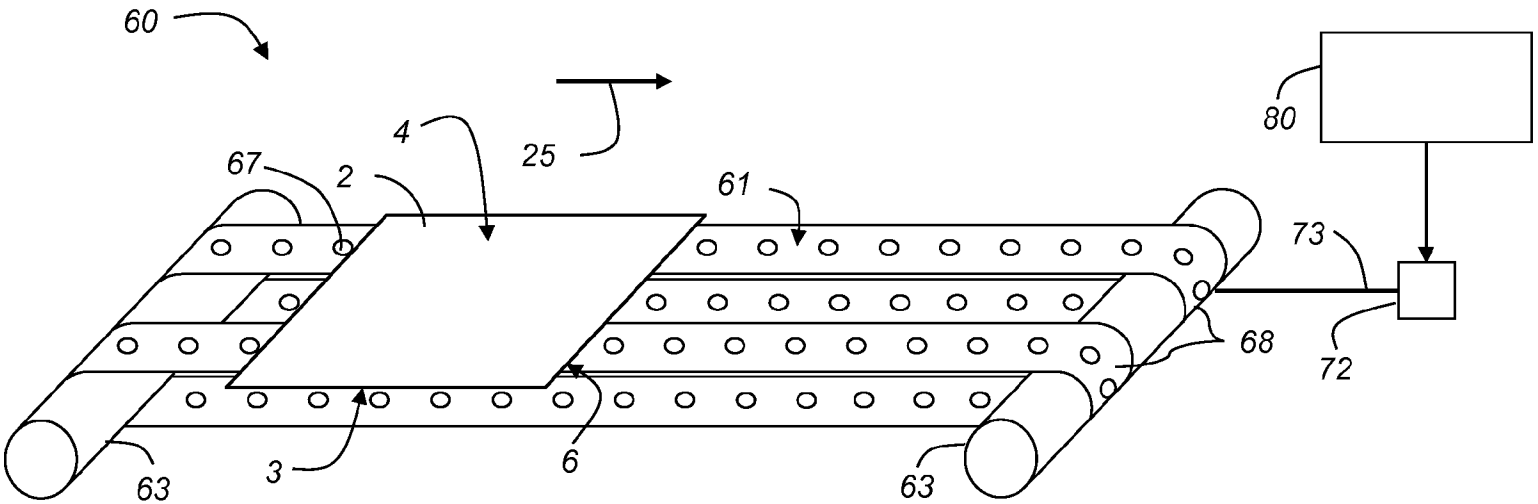
FIG. 4 shows a perspective of a media transport comprising a vacuum belt.

FIG. 4 shows a perspective of an exemplary second media transport 60 for transporting media sheet 2 in second direction 25. In this example, the second media transport 60 is a vacuum belt system including a plurality of belt strips 68 travelling around a plurality of rollers 63, each belt strip having a plurality of vacuum holes 67. The second side 3 of media sheet 2 is held by a vacuum force (provided by second media transport force mechanism 72 and the force transfer element 73) through vacuum holes 67 in the upper belt portion 61 of the belt strips 68.

Figure 2E:
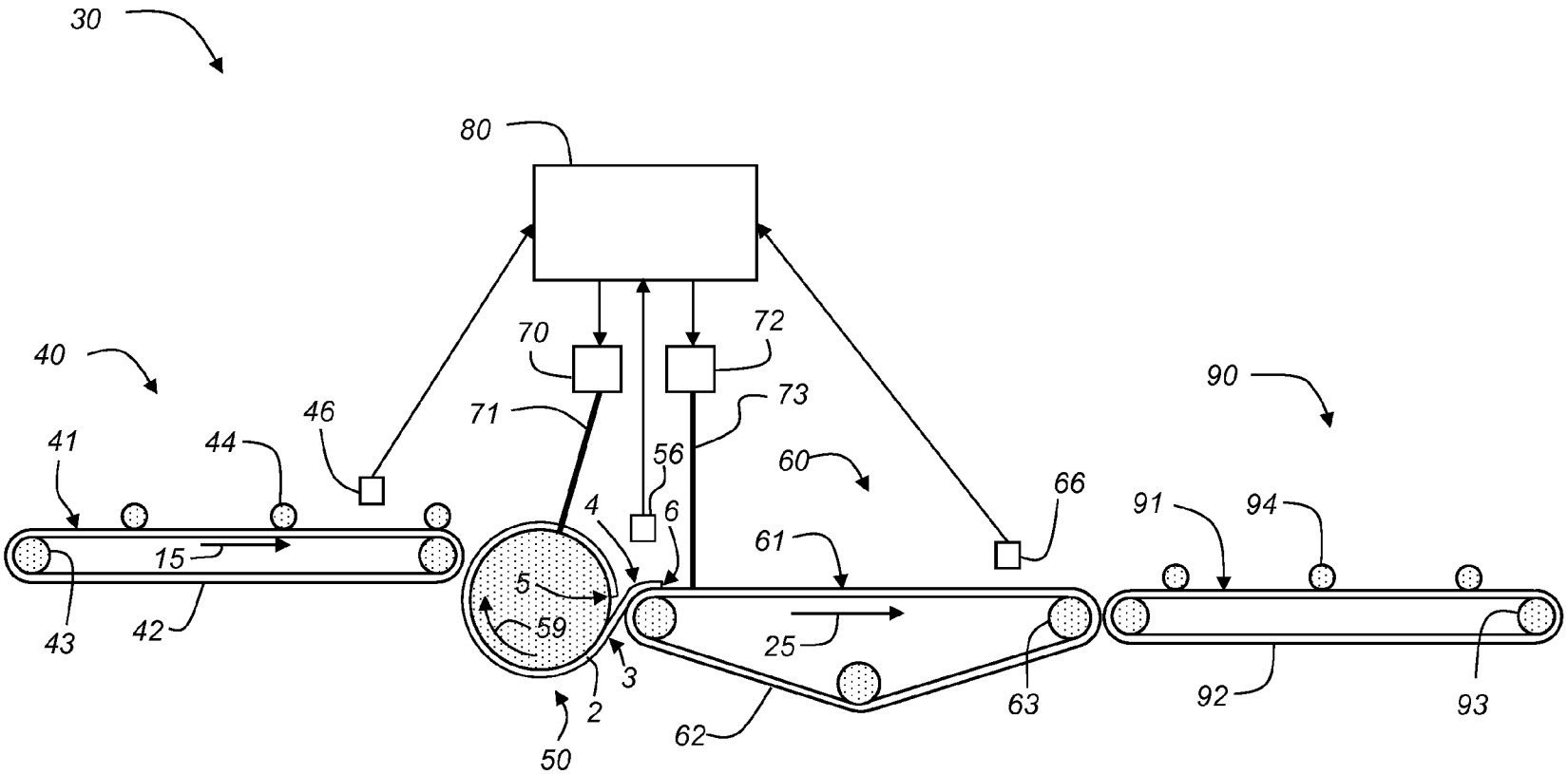

FIG. 2E is similar to FIG. 2D, but shows a later time when second media transport force mechanism 72 is switched to its first state to attract and hold the extended second side 3 of media sheet 2 to the second media transport 60. In a preferred embodiment, controller 80 controls the second media transport force mechanism 72 to switch from its second state to its first state when media sensor 56 provides a signal to controller 80 indicating that second edge 6 of media sheet 2 is approaching the second media transport 60.

Figure 2F:
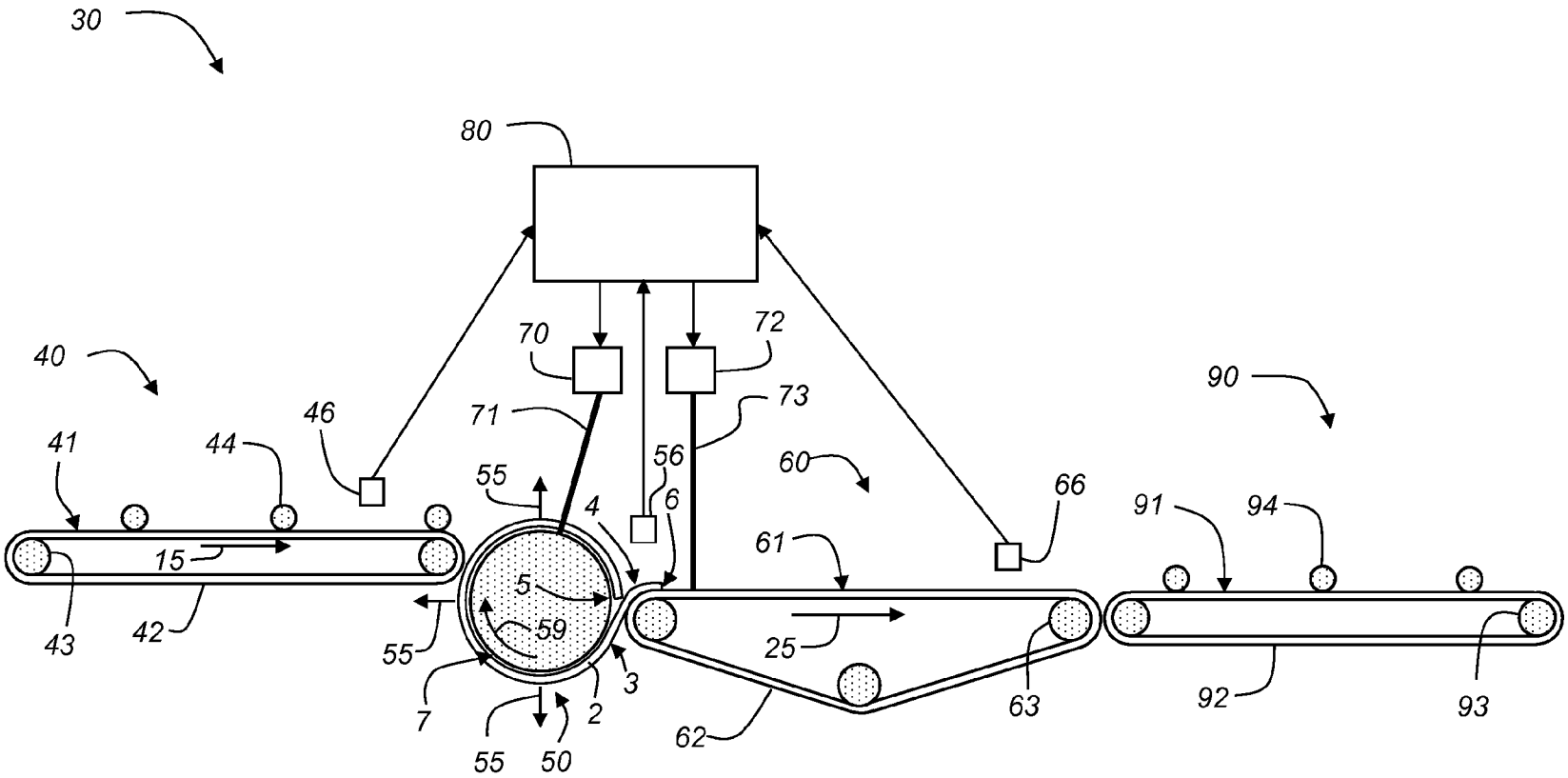

FIG. 2F is similar to FIG. 2E and shows a time just slightly after the time of FIG. 2E, where the controller 80 has controlled the rotatable member force mechanism 70 to switch from its first state to its second state, thereby releasing the media sheet 2 from being held to rotatable member 50. Comparing FIG. 2F to FIG. 2E it can be seen that there is a small gap 7 between the media sheet 2 and the rotatable member 50 in FIG. 2F, indicating that the media sheet 2 has been released. In a preferred embodiment, controller 80 switches the rotatable member force mechanism 70 to the second state to release media sheet 2 in synchronization with the second edge 6 of the media sheet 2 being received by the second media transport 60, such that the media sheet 2 is unwrapped from around rotatable member 50 and advanced along the second media transport path with the second edge 6 of media sheet 2 now becoming the leading edge.

Arrows 55, which are directed radially outward from rotatable member 50 indicate the movement of media sheet 2 outward from rotatable member 50 when rotatable member force mechanism 70 is switched to its second state to release the media sheet 2. In some embodiments, the radial force that moves media sheet 2 outward from rotatable member 50 can be provided by the tendency of media sheet 2 to resume its original flat shape. In other embodiments, the rotatable member force mechanism 70 provides an attractive force between the media sheet 2 and the rotatable member 50 in its first state and a repelling force between the media sheet 2 and the rotatable member 50 in its second state. For example, for embodiments where rotatable member force mechanism 70 is a vacuum force mechanism that provides a vacuum force in its first state to attract media sheet 2 to rotatable member 50, the rotatable member force mechanism 70 can blow air outwardly through the vacuum holes 57 (FIG. 3) to repel the media sheet 2 away from the rotatable member 50 in its second state, thereby releasing the media sheet 2 from being held to the rotatable member 50. In this case, the positive airflow has the additional advantage that it can provide an "air bearing" effect to reduce friction between the rotatable member 50 and media sheet 2 while media sheet 2 is being unwrapped from around the rotatable member 50.

Switching the rotatable member force mechanism 70 to its second state in synchronization with the second edge 6 of the media sheet 2 being received by the second media transport 60 does not necessarily mean that the two events are simultaneous. In some embodiments, the switching of the rotatable member force mechanism 70 to the second state can be before or after the media sheet 2 is received by the second media transport 60 by some predefined time interval. Typically such a time interval would be less than 1 second, and in some embodiments would be between 0.0-0.1 seconds.

In some embodiments, controller 80 controls the second media transport force mechanism 72 to be in its second state while the rotatable member 50 is receiving the media sheet 2 as in FIG. 2B, and then switches the second media transport force mechanism 72 to its first state to receive the second edge 6 of the media sheet 2 and hold the media sheet 2 to second media transport 60 as it is advanced along the second media transport path. In such embodiments, controller 80 switches the second media transport force mechanism 72 to its first state in synchronization with switching the rotatable member force mechanism 70 to its second state. Switching the second media transport force mechanism 72 to its first state in synchronization with switching the rotatable member force mechanism 70 to its second state does not necessarily mean that the two events are simultaneous. In some embodiments, as suggested in FIGS. 2E and 2F, the switching of the rotatable member force mechanism 70 to the second state can be after the switching of the second media transport force mechanism 72 to its first state by some predefined time interval. In other embodiments (not shown) the switching sequence can be reversed.

Figure 2G:
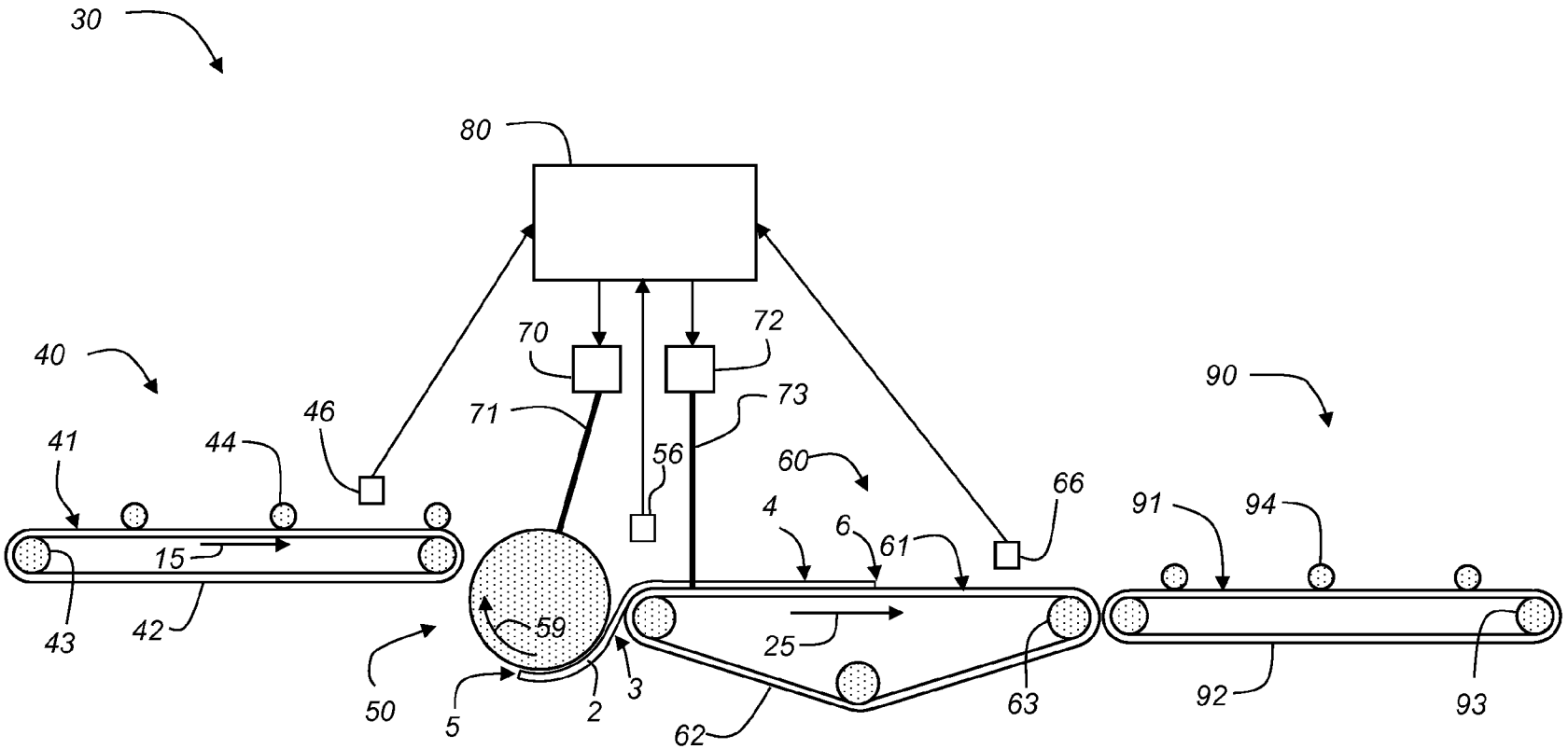

FIG. 2G is similar to FIG. 2F, but shows a later time when the media sheet 2 is mostly unwrapped from the rotatable member 50 and is being advanced by the second media transport 60 with the second side 3 of media sheet 2 being held to upper belt portion 61 of belt 62. Second edge 6 of media sheet 2 is now the leading edge. At the time, the second media transport force mechanism 72 is maintained in its first state to hold the media sheet 2 tightly to the belt 62.

Comparing FIGS. 2A-2G it can be seen that the rotatable member 50 continuously rotates in a single rotation direction 59 during the entire media inversion process. In contrast to the media inverter art cited in the background, rotatable member 50 is never reversed to turn in a reverse direction opposite to rotation direction 59. This provides a substantial throughput advantage relative to the prior art. In some embodiments a rotation speed of rotatable member 50 can be adjusted while media sheet 2 is being wrapped around rotatable member 50. (For example, the rotation speed can be slowed down somewhat.) Such a rotational speed adjustment can be used to control how tightly the media sheet 2 is wrapped around rotatable member 50. The rotatable member 50 does not need to be turned in a reverse direction while media sheet 2 is being unwrapped and received by the second media transport 60 because the media sheet 2 is released from the rotatable member 50 at that point.

Figure 2H:
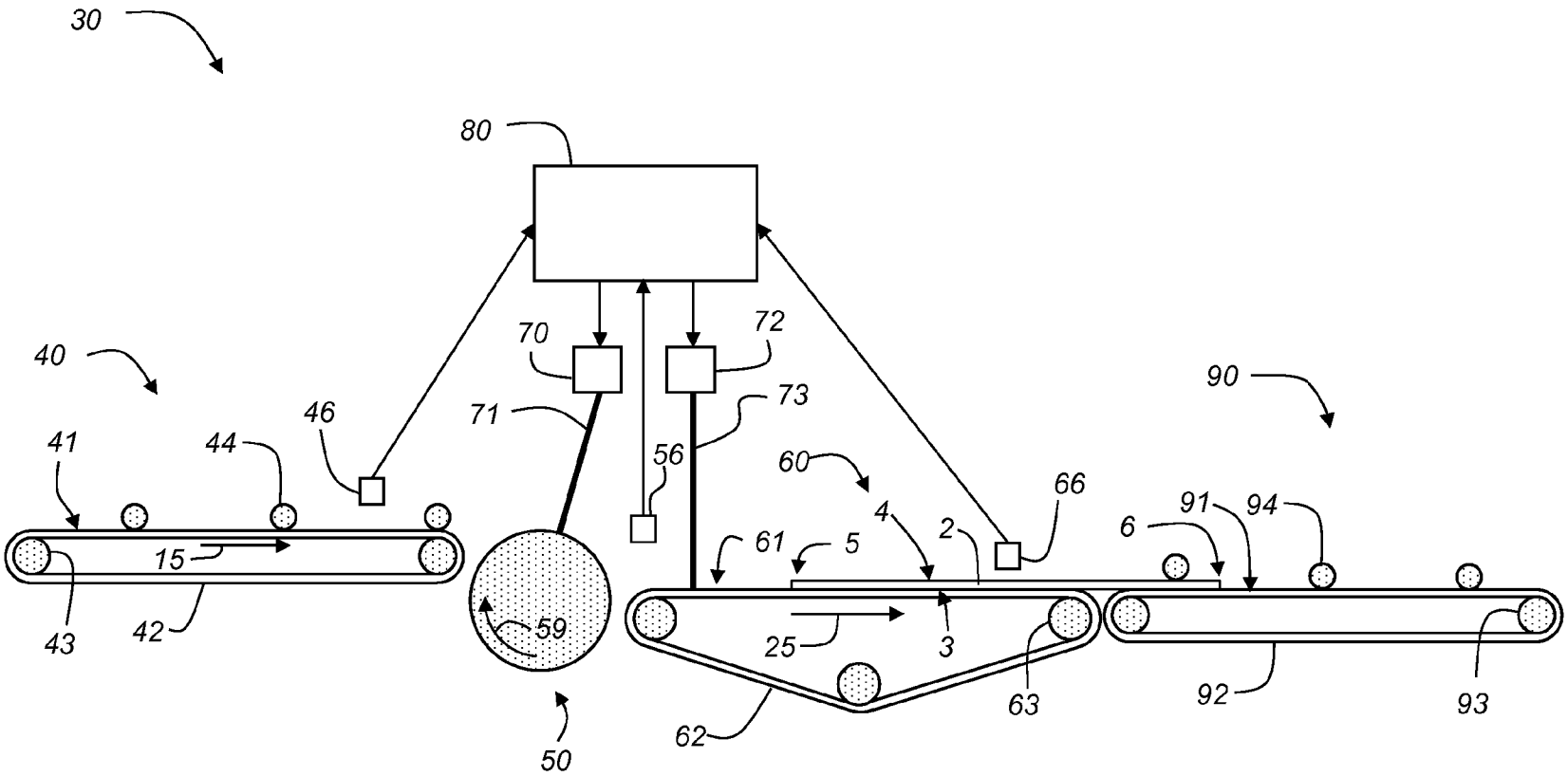

FIG. 2H is similar to FIG. 2G, but shows a later time when the media sheet 2 is completely unwrapped from the rotatable member 50. At this point, the rotatable member 50 could receive a subsequent media sheet 2 for inverting. In this exemplary embodiment, the rotatable member 50 is shown as continuing to rotate in rotation direction 59. If there are no subsequent media sheets 2 entering the media inverter 30, the rotatable member 50 can be stopped. By saying that rotatable member 50 continuously rotates in a rotation direction 59, it is not meant that rotatable member 50 always rotates in rotation direction 59. Rather it is meant that the rotatable member 50 does not reverse directions during the media inversion process.

Also shown in FIG. 2H is a third media transport 90 that receives media sheet 2 from second media transport 60. In the example shown in FIG. 2H, third media transport 90 is a transport belt system including a belt 92 that travels around a plurality of rollers 93. Nip rollers 94 hold the media sheet 2 to upper belt portion 91 of belt 92 and advance the media sheet 2 along the transport path. As media sheet 2 leaves the second media transport 60, a media sensor 66 can detect the trailing first edge 5 and send a signal to controller 80. Controller 80 can then switch the second media transport force mechanism 72 into its second state to release the media sheet 2 from the second media transport 60.

Figure 3:
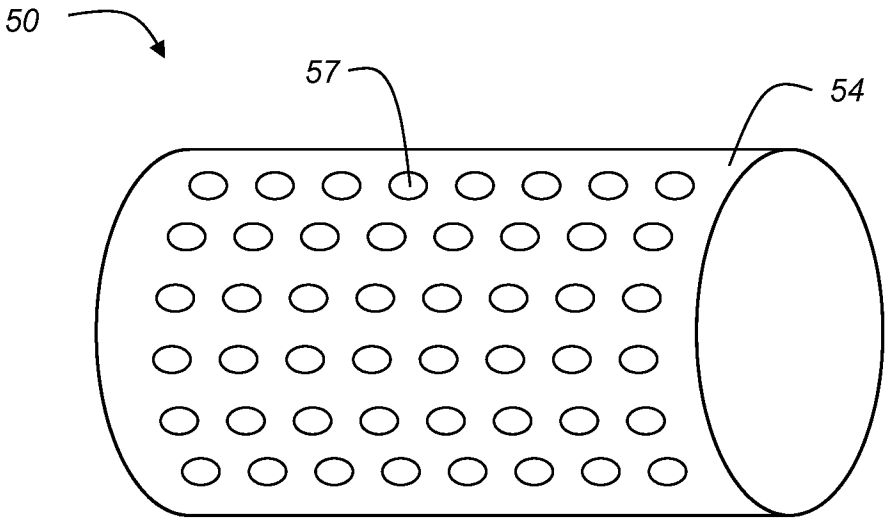
FIG. 3 shows a perspective of a rotatable member that is a vacuum drum.

FIG. 3 shows a perspective of an exemplary embodiment of a rotatable member 50, where the rotatable member 50 is a drum having a circumferential surface 54 around which media sheet 2 is wrapped as described above relative to FIGS. 2A through 2H. Air is drawn inwardly through vacuum holes 57 in the first state to hold media sheet 2 against circumferential surface 54 of the drum. In some embodiments, in the second state air is no longer drawn inwardly through the vacuum holes 57 so that the media sheet 2 is released from being held against the circumferential surface 54. In other embodiments, in the second state air is blown outwardly through the vacuum holes 57 to actively push the media sheet 2 away from the circumferential surface 54, thereby assisting in its release from the rotatable member 50.

Figure 5:
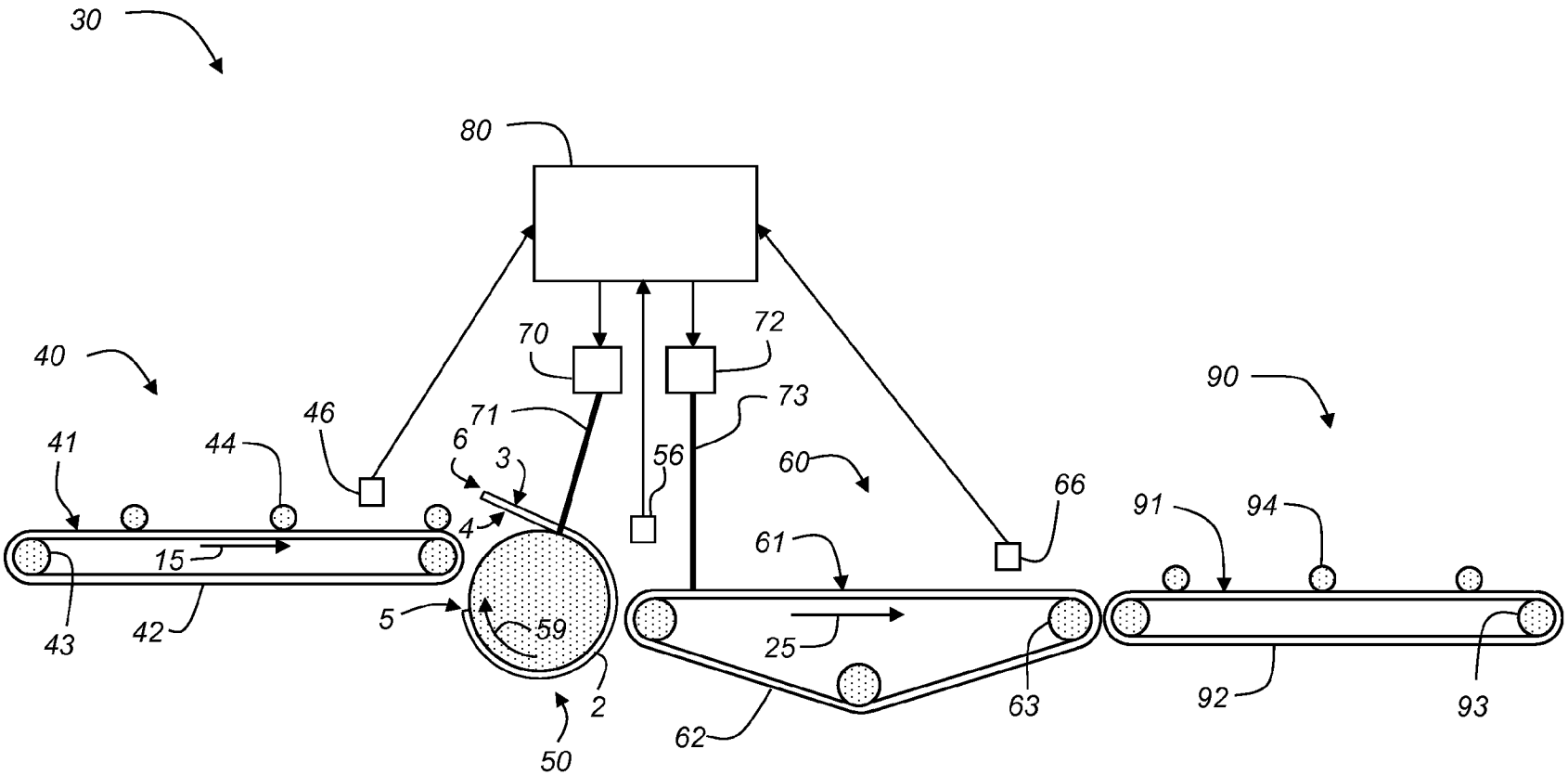
FIG. 5 shows a side view of a media inverter similar to FIG. 2C, but where the media sheet is shorter than the circumference of the rotatable member.

In some embodiments, as described above with reference to FIG. 2C, the circumference of the rotatable member 50 is less than a length between the first edge 5 and the second edge 6 of the media sheet 2, such that the second edge 6 of the media sheet 2 overlaps the first edge 5, thereby preventing the second edge 6 from being held to the rotatable member 50. In other embodiments, as shown in FIG. 5, the circumference of the rotatable member 50 is greater than the length between the first edge 5 and the second edge 6 of the media sheet 2. In such embodiments, the rotatable member force mechanism 70 is preferably adapted so that it only provides a force to hold the media sheet 2 to the rotatable member 50 over a portion of the length of media sheet 2 that includes the first edge 5 but does not include the second edge 6, thereby preventing the second edge 6 from being held to the rotatable member 50. For example, with reference also to FIG. 3, vacuum holes 57 can be provided around only a portion of circumferential surface 54.

Figure 6:
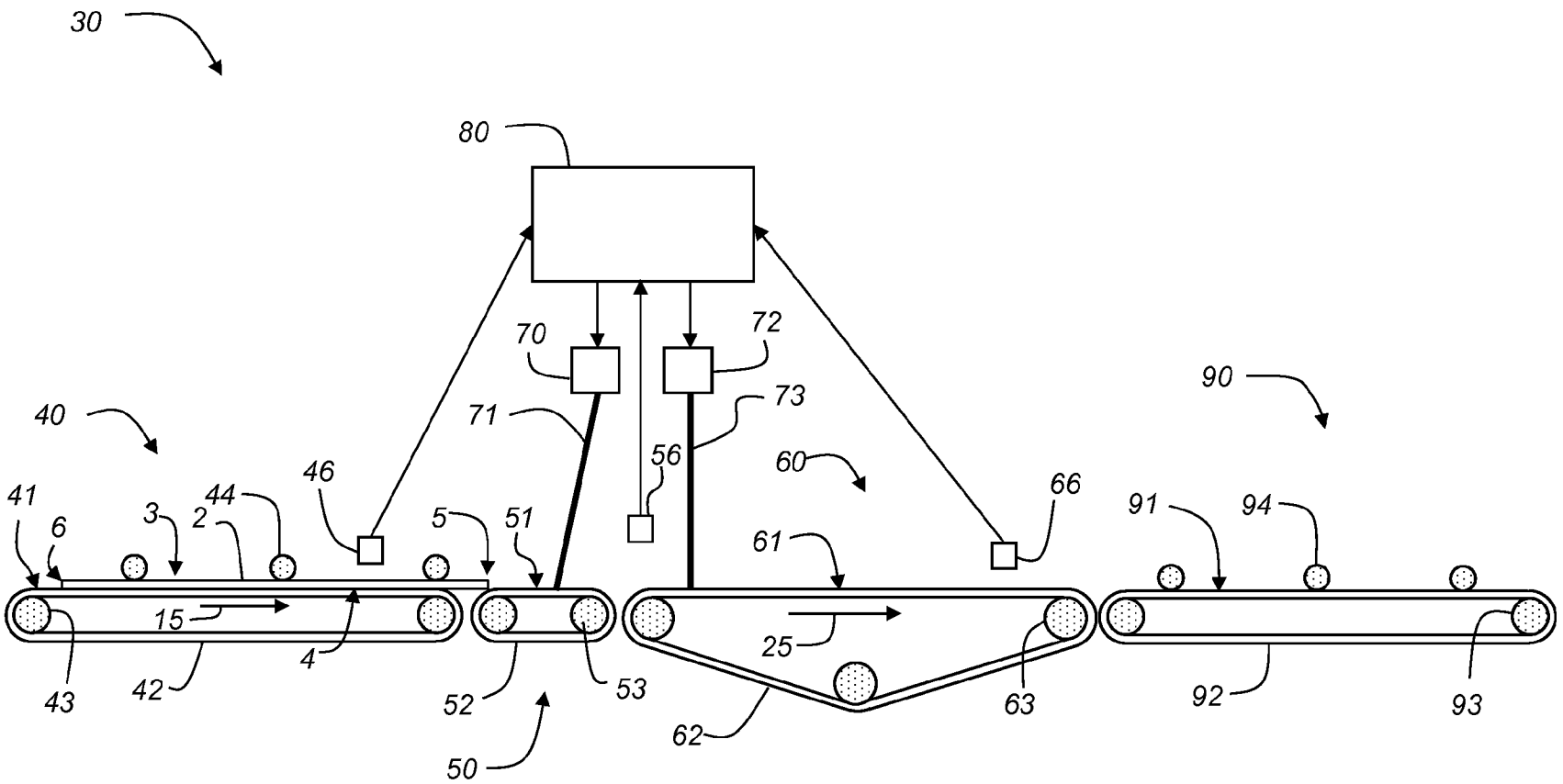
FIG. 6 shows a side view of a media inverter similar to FIG. 2A, but where the rotatable member is a belt system.

In the exemplary embodiment shown in FIGS. 2A-2H, the rotatable member 50 is a drum. FIG. 6 shows a side view of a media inverter 30 according to an alternate embodiment where the rotatable member 50 is a belt system including a belt 52 travelling around a plurality of rollers 53 along a belt path. During the inversion process, the media sheet 2 does not remain only on upper belt portion 51 of belt 52, but is wrapped around the belt 52 and subsequently unwrapped in similar fashion as was described above relative to FIGS. 2A-2H. In some embodiments, the belt 52 can be a vacuum belt with vacuum holes similar to the vacuum holes 67 shown in FIG. 4.

Figure 7A:
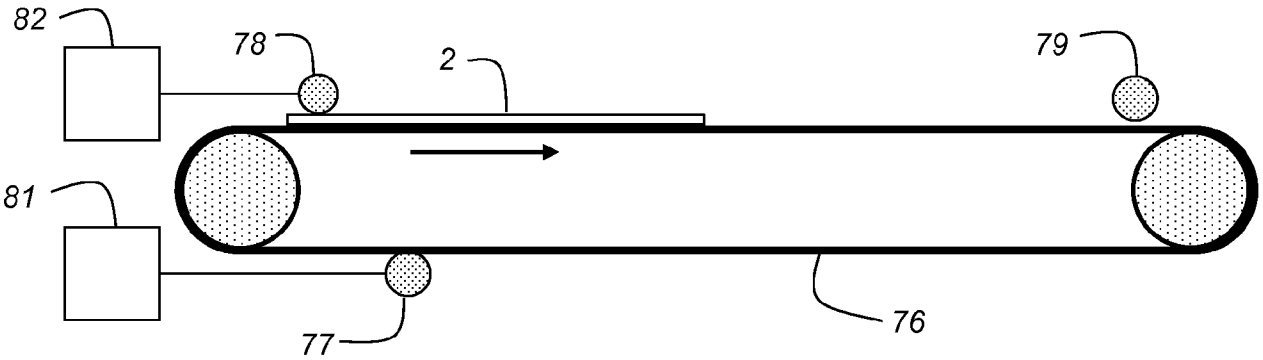
FIGS. 7A-7B show side views of belt systems where the hold-down force is provided electrostatically by charging rollers or corona systems, respectively.

In an alternate embodiment, one or both of the rotatable member force mechanism 70 and the second media transport force mechanism 72 can provide an electrostatic hold-down force. FIG. 7A shows a belt 76 having an electrically insulating surface. A belt charging roller 77 is selectively provided a high voltage by voltage source 81 and applies a charge to the electrically insulating surface of belt 76. A sheet charging roller 78 is selectively provided a high voltage of the opposite polarity by voltage source 82 to charge the media sheet 2 with an opposite charge, so that the media sheet 2 is attracted to the belt 76, thereby providing the first state. A discharging roller 79 is selectively connected to ground and bleeds charge off at least one of the belt 76 and the media sheet 2, thereby removing the attractive force and providing the second state.

Figure 7B:
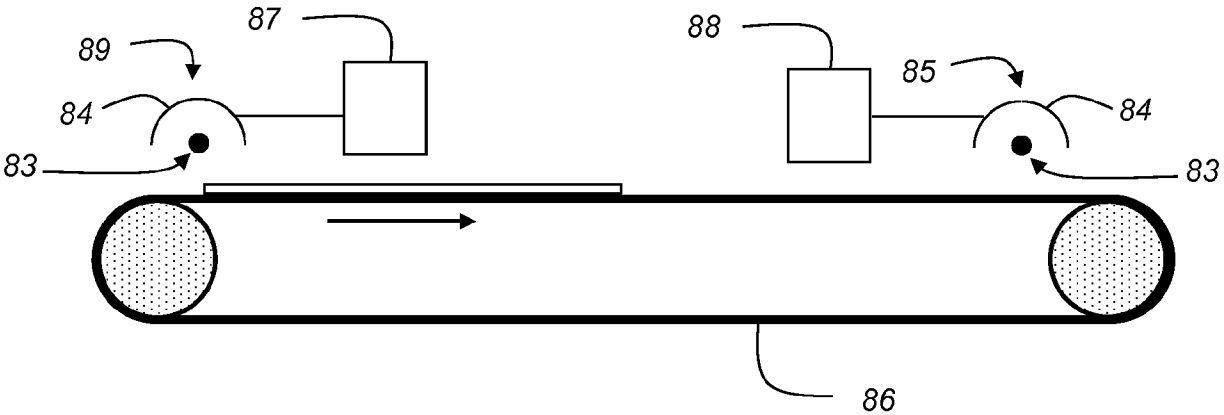

FIG. 7B shows another embodiment of an electrostatic hold-down belt system where non-contact corona units are used for selectively supplying the charge (to provide the first state) and for selectively neutralizing the charge (to provide the second state). Belt 86 has an electrically insulating surface. At least one corona charging unit 89 includes a wire 83 that is provided a high DC voltage by DC voltage source 87. Typically, a shield 84 partially surrounds the wire 83 but is open where the corona charging unit 89 faces the belt 86. The high voltage causes ionization and charged particles (electrons or ions) are showered onto the belt 86 or the media sheet 2 to provide the attractive force. Optionally a grid (not shown) between wire 83 and belt 86 can be used to control the rate of flow of charge from the corona charging unit 89. A corona discharging unit 85 is provided a high AC voltage by an AC voltage source 88. Charges of both signs are directed toward at least one of the media sheet 2 and the belt 86. Charges of the same polarity as the charge on the media sheet 2 or the belt 86 are repelled, while opposite polarity charges are attracted, thereby at least partially neutralizing the charge and removing the attractive force.

Various types of assist mechanisms can be used in assisting the transfer of the media sheet 2 from the rotatable member 50 to the second media transport 60. One such mechanism was described above relative to FIGS. 2F and 3, where the rotatable member force mechanism 70 provides a repelling force (such as air blown through vacuum holes 57) in its second state to aid in the release of media sheet 2 from rotatable member 50.

Figure 8A:
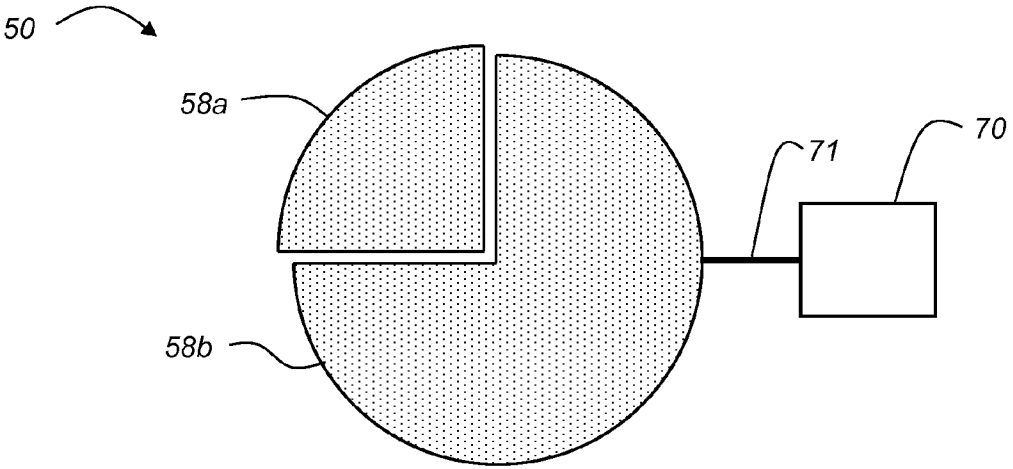
FIGS. 8A-8B show side views of a rotatable member having a circumference that can be selectively increased or reduced.
Figure 8B:
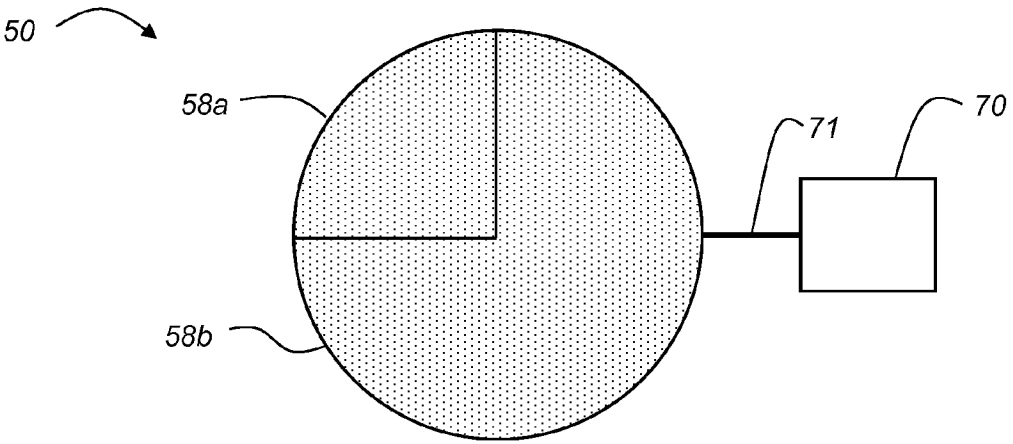

A second type of assist mechanism for aiding the release of media sheet from rotatable member 50 is shown in the side views of FIGS. 8A and 8B, where the rotatable member 50 includes one or more sectors that can be adjusted to control a circumference of the rotatable member 50. In the illustrated embodiment, the rotatable member 50 is a drum including a moveable first sector 58*a* that can be moved outward away from a center of the rotatable member 50 a fixed second sector 58*b*. FIG. 8A shows the configuration of rotatable member 50 when the rotatable member force mechanism 70 is in its first state for attracting and holding a media sheet. In this case, the first sector 58*a* is moved outwardly away from the center of the rotatable member 50, such that the circumference of rotatable member 50 is increased. FIG. 8B shows the configuration of rotatable member 50 when rotatable member force mechanism 70 is in its second state for releasing a media sheet. In this case, the first sector 58*a* is moved inwardly toward the center of the rotatable member 50 to reduce the circumference of rotatable member 50. This has the effect of assisting in the releasing of the media sheet 2 from being held to rotatable member 50 and forming the gap 7 (FIG. 2F).

Figure 9:
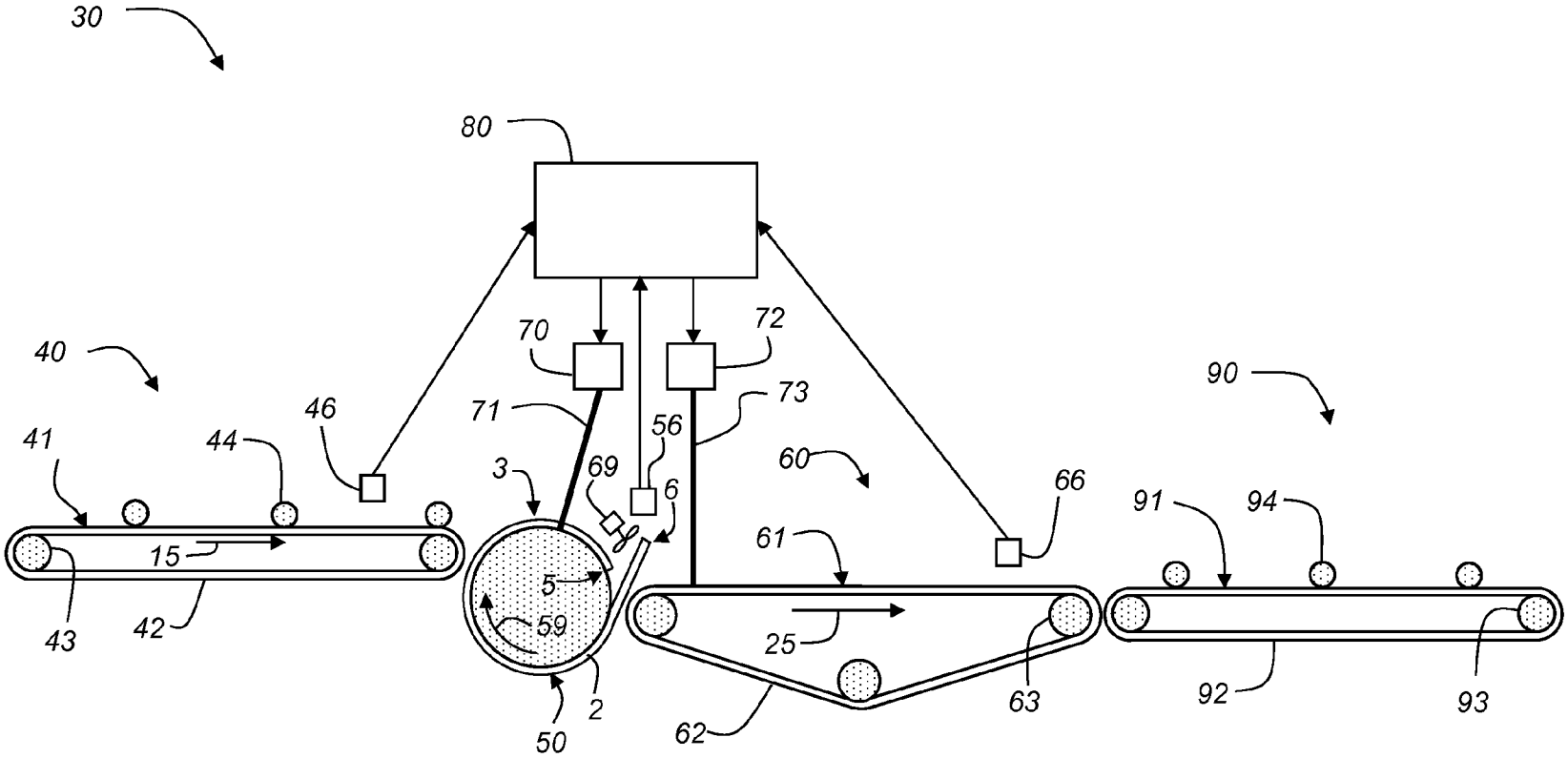
FIG. 9 shows a side view of a media inverter similar to FIG. 2D, but where the media inverter also includes a blower for pushing a second edge of the media sheet toward the second media transport.

FIG. 9 is similar to FIG. 2D but also includes a blower 69 that serves as an assist mechanism for pushing the second edge 6 of the media sheet 2 toward the second media transport 60 while the second edge 6 of media sheet 2 is being received by the second media transport 60. In particular, the blower 69 provides a jet of air to push the second edge 6 toward the second media transport 60 to provide the configuration of media sheet 2 seen in FIG. 2E. In some configurations, the blower 69 can be activated in synchronization with the second media transport force mechanism 72 being switched to its first state to receive the media sheet 2. In other configurations, the blower 69 can blow constantly. A movable mechanical finger (not shown) for pushing the second edge 6 of the media sheet 2 toward the second media transport can alternatively be used to push the second edge 6 toward the second media transport 60.

Figure 10:
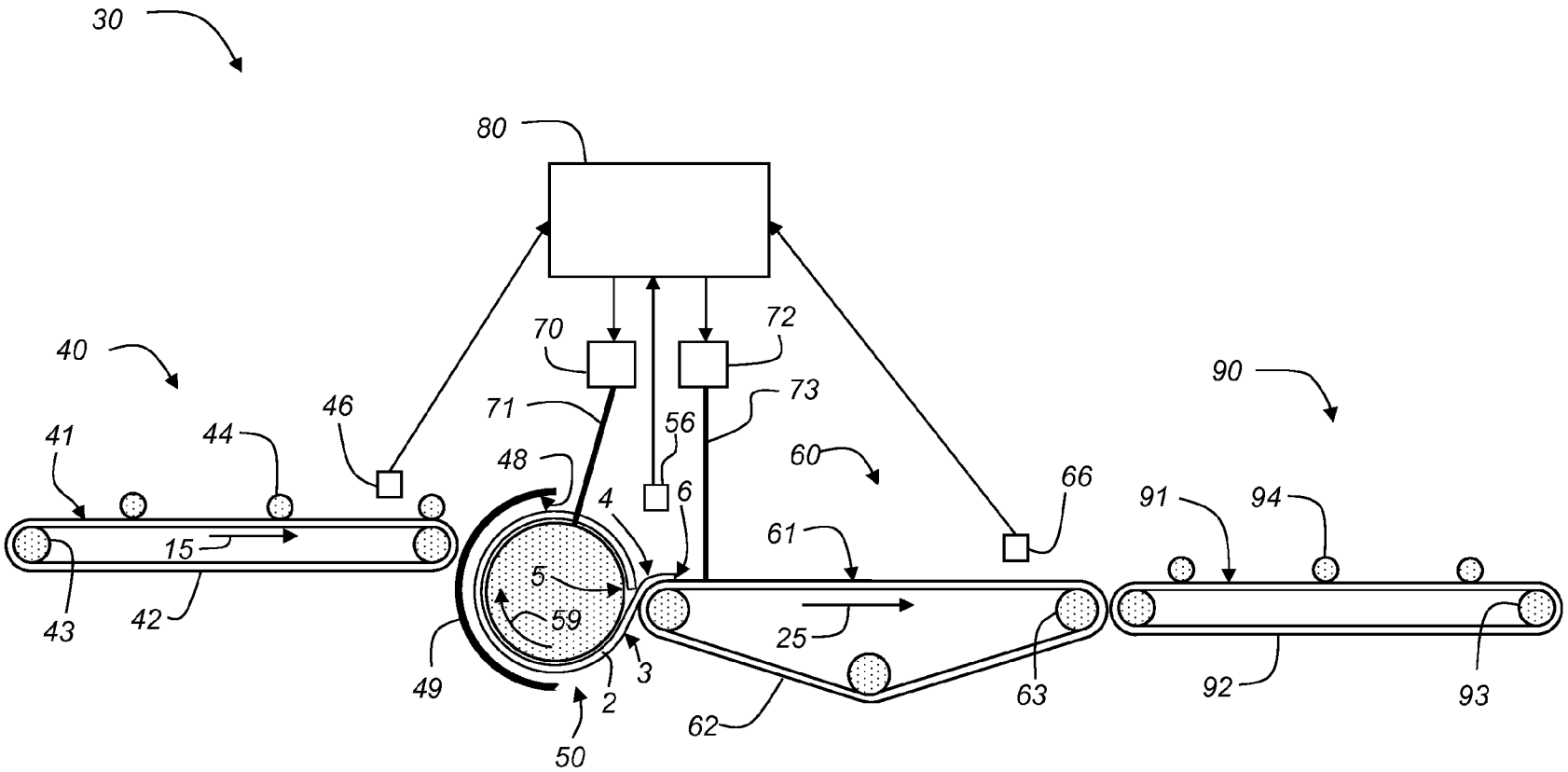
FIG. 10 shows a side view of a media inverter similar to FIG. 2F, but where the media inverter also includes a media guiding mechanism partially surrounding the rotatable member.

Media inverter 30 can also include various types of guides to guide the media during the inversion process. FIG. 10 is similar to FIG. 2F, but also includes a fender-like guiding mechanism 49 that partially surrounds the rotatable member 50 for guiding the media sheet 2 as the media sheet 2 is unwrapped from around the rotatable member 50. Guiding mechanism 49 can prevent the media sheet 2 from colliding with the first media transport 40 or other printer system components as it is being unwrapped from around the rotatable member 50. Guiding mechanism 49 can optionally be provided with a low friction inner surface 48 or passive rollers (not shown) at inner surface 48 to reduce the amount of drag on the media sheet 2 if it strikes the inner surface 48 of the guiding mechanism 49.

Figure 11:
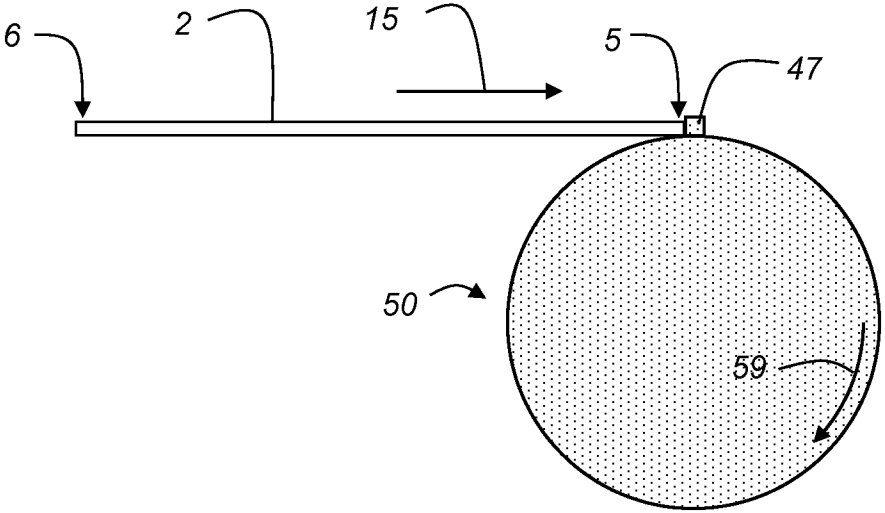
FIG. 11 shows a side view of a rotatable member including an edge stop for aligning the media sheet.

Another type of guiding member that can be incorporated into rotatable member 50 is one or more edge stops 47 as shown in FIG. 11. As media sheet 2 is being advanced along first direction 15 by first media transport 40 (see also FIG. 2A) with first edge 5 being the leading edge, the edge stop 47 can align the media sheet 2 with the rotatable member 50. Optionally the rotational speed of rotatable member 50 or the belt speed of first media transport 40 can be adjusted to properly position the edge stop 47 as the first edge 5 approaches the rotatable member 50. For embodiments where vacuum holes 57 (FIG. 3) or vacuum grooves (not shown) are only provided around a portion of circumferential surface 54 of rotatable member 50 as described above with reference to FIG. 5, the edge stop 47 can also properly position the media sheet 2 such that the second edge 6 will not be held to the rotatable member 50.

The invention has been described in detail with particular reference to certain preferred embodiments thereof, but it will be understood that variations and modifications can be effected within the spirit and scope of the invention.

PARTS LIST

2 media sheet
3 second side
4 first side
5 first edge
6 second edge
7 gap
10 first printing module
11 input
12 output
14 printing stations
15 first direction
20 second printing module
21 input
24 printing stations
25 second direction
30 media inverter
40 first media transport
41 upper belt portion
42 belt
43 roller
44 nip roller
45 media transport path
46 media sensor
47 edge stop
48 inner surface
49 guiding mechanism
50 rotatable member
51 upper belt portion
52 belt
53 roller
54 circumferential surface
55 arrow
56 media sensor
57 vacuum holes
58*a* first sector
58*b* second sector
59 rotation direction
60 second media transport
61 upper belt portion
62 belt
63 roller
65 media transport path
66 media sensor
67 vacuum holes
68 belt strips
69 blower
70 rotatable member force mechanism
71 force transfer element
72 second media transport force mechanism
73 force transfer element
76 belt
77 belt charging roller
78 sheet charging roller
79 discharging roller
80 controller
81 voltage source
82 voltage source
83 wire
84 shield
85 corona discharging unit
86 belt
87 DC voltage source
88 AC voltage source
89 corona charging unit
90 third media transport
91 upper belt portion
92 belt
93 roller
94 nip roller
100 cut-sheet printing system

The invention claimed is:

1. A media inverting system for a cut sheet printing system, comprising:

a first media transport for advancing a media sheet along a first media transport path;

a rotatable member continuously rotating in a rotation direction, the rotatable member being adapted to receive the media sheet from the first media transport and wrap the media sheet around the rotatable member;

a rotatable member force mechanism switchable between a first state and a second state, such that when the rotatable member force mechanism is in its first state a first side of the media sheet is held to the rotatable member at least along a leading first edge of the media sheet, a trailing second edge of the media sheet not being held to the rotatable member, and when the rotatable member force mechanism is in its second state the media sheet is released from being held to the rotatable member;

a second media transport for receiving the media sheet from the rotatable member and advancing the media sheet along a second media transport path;

a second media transport force mechanism for holding a second side of the media sheet to the second media transport at least along the second edge of the media sheet;

a control system for controlling the rotatable member force mechanism according to a control sequence including:

switching the rotatable member force mechanism to its first state to receive the media sheet from the first media transport and hold the first side of the media sheet to the rotatable member while it is wrapped around the rotatable member; and switching the rotatable member force mechanism to its second state to release the media sheet from being held to the rotatable member in synchronization with the second edge of the media sheet being received by the second media transport such that the media sheet is unwrapped from around the rotatable member and advanced along the second media transport path so that the second edge of the media sheet becomes the leading edge.

2. The media inverting system of claim 1 wherein the second media transport force mechanism is switchable between a first state and a second state, such that when the second media transport force mechanism is in its first state the second side of the media sheet is held to the second media transport at least along the second edge of the media sheet, and when the second media transport force mechanism is in its second state the media sheet is not held to the rotatable member.

3. The media inverting system of claim 2 wherein the control system also controls the second media transport force mechanism according to a control sequence including:

switching the second media transport force mechanism to the second state while the rotatable member is receiving the media sheet; and switching the second media transport force mechanism to its first state to receive the second edge of the media sheet and hold the media sheet to the second transport mechanism as it is advanced along the second media transport path;

wherein the control system switches the second media transport force mechanism to its first state in synchronization with switching the rotatable member force mechanism to its second state.

4. The media inverting system of claim 1 wherein a circumference of the rotatable member is less than a length between the first edge and the second edge of the media sheet such that the second edge of the media sheet overlaps the first edge of the media sheet when the media sheet is wrapped around the rotatable member thereby preventing the second edge from being held to the rotatable member.

5. The media inverting system of claim 1 wherein a circumference of the rotatable member is greater than a length between the first edge and the second edge of the media sheet, and wherein the rotatable member force mechanism only provides a force to hold the media sheet to the rotatable member over a portion of the media sheet that includes a region proximate to the first edge but does not include the second edge thereby preventing the second edge from being held to the rotatable member.

6. The media inverting system of claim 1 wherein the rotatable member is a drum.

7. The media inverting system of claim 1 wherein the rotatable member is a belt system including at least one belt travelling around a plurality of rollers along a belt path.

8. The media inverting system of claim 1 wherein the rotatable member force mechanism is a vacuum force mechanism that provides a vacuum force in its first state to hold the first side of the media sheet to the rotatable member.

9. The media inverting system of claim 8 wherein the rotatable member force mechanism blows air through holes in the rotatable member onto the first side of media sheet in its second state, thereby releasing the media sheet from being held to the rotatable member.

10. The media inverting system of claim 1 wherein the rotatable member force mechanism is an electrostatic force mechanism that provides an electrostatic force in its first state to hold the first side of the media sheet to the rotatable member.

11. The media inverting system of claim 1 wherein the rotatable member force mechanism provides an attractive force between the media sheet and the rotatable member in its first state and a repelling force between the media sheet and the rotatable member in its second state.

12. The media inverting system of claim 1 wherein a circumference of the rotatable member is reduced when the rotatable member force mechanism is switched to its second state to assist in releasing the media sheet from being held to the rotatable member.

13. The media inverting system of claim 1 wherein a rotation speed of the rotatable member is adjusted while the media sheet is being wrapped around the rotatable member.

14. The media inverting system of claim 1 further including an assist mechanism for pushing the second edge of the media sheet toward the second media transport while the second edge of the media sheet is being received by the second media transport.

15. The media inverting system of claim 14 wherein the assist mechanism is a jet of air provided by a blower.

16. The media inverting system of claim 1 wherein one or both of the first media transport and the second media transport are transport belt systems, each transport belt system including a transport belt travelling along a transport belt path around a plurality of rollers.

17. The media inverting system of claim 16 wherein at least one of the transport belt systems is a vacuum belt system.

18. The media inverting system of claim 1 wherein one or both of the first media transport and the second media transport include nip rollers for advancing the media sheet.

19. The media inverting system of claim 1 further including a guiding mechanism around the rotatable member to guide the media sheet as the media sheet is unwrapped from around the rotatable member.

20. The media inverting system of claim 1 further including one or more sensors to detect a position of the second edge of the media sheet, wherein the control system controls the switching of the rotatable member force mechanism responsive to the detected position of the second edge of the media sheet.

21. The media inverting system of claim 1 wherein the rotatable member includes one or more edge stops adapted to align the media sheet with the rotatable member.

* * * * *